US008553058B2

(12) United States Patent
Huang

(10) Patent No.: US 8,553,058 B2
(45) Date of Patent: Oct. 8, 2013

(54) PRESSURE ADJUSTING MECHANISM FOR ADJUSTING PRESSURE OF A THERMAL PRINT HEAD AND THERMAL SUBLIMATION PRINTER THEREWITH

(75) Inventor: Chun-Chia Huang, New Taipei (TW)

(73) Assignee: HiTi Digital, Inc., Xindian Dist., New Taipei (TW)

( * ) Notice: Subject to any disclaimer, the term of this patent is extended or adjusted under 35 U.S.C. 154(b) by 0 days.

(21) Appl. No.: 13/491,611

(22) Filed: Jun. 8, 2012

(65) Prior Publication Data

US 2013/0176373 A1 Jul. 11, 2013

(30) Foreign Application Priority Data

Jan. 9, 2012 (TW) ..... 101100857 A

(51) Int. Cl.
*B41J 2/335* (2006.01)
*B41J 25/304* (2006.01)

(52) U.S. Cl.
USPC ..... 347/198

(58) Field of Classification Search
USPC ..... 347/197, 198; 400/120.16, 120.17
See application file for complete search history.

(56) References Cited

U.S. PATENT DOCUMENTS

| | | | | |
|---|---|---|---|---|
| 5,366,302 | A * | 11/1994 | Masumura et al. | 400/120.16 |
| 7,145,583 | B2 * | 12/2006 | Ito | 347/197 |
| 8,436,880 | B2 * | 5/2013 | Matsushima et al. | 347/197 |
| 8,449,207 | B2 * | 5/2013 | Takabatake et al. | 400/120.16 |
| 2002/0080223 | A1 * | 6/2002 | Connor | 347/198 |

* cited by examiner

*Primary Examiner* — Kristal Feggins
(74) *Attorney, Agent, or Firm* — Winston Hsu; Scott Margo

(57) ABSTRACT

A pressure adjusting mechanism for adjusting pressure applied on a thermal print head includes a pressing plate, a plurality of resilient members and a pressure adjusting member. The pressing plate is disposed above the thermal print head and comprising a first pressed section and a second pressed section connected to the first pressed section. The plurality of resilient members is connected to the first pressed section of the pressing plate and the thermal print head and to the second pressed section of the pressing plate and the thermal print head, respectively. The pressure adjusting member is pivoted to the pressing plate for driving the pressing plate to move relative to the thermal print head, so as to press the plurality of resilient members for providing the thermal print head with pressure, such that the plurality of resilient members drives the pressing plate to equilibrate the pressing plate.

14 Claims, 5 Drawing Sheets

PRESSURE ADJUSTING MECHANISM FOR ADJUSTING PRESSURE OF A THERMAL PRINT HEAD AND THERMAL SUBLIMATION PRINTER THEREWITH

BACKGROUND OF THE INVENTION

1. Field of the Invention

The present invention relates to a pressure adjusting mechanism and a thermal sublimation printer therewith, and more particularly, to a pressure adjusting mechanism for adjusting pressure of a thermal print head and a thermal sublimation printer therewith.

2. Description of the Prior Art

Generally speaking, a conventional thermal sublimation printer utilizes a plurality of springs disposed on a thermal print head to provide the thermal print head with a pressure, and the conventional thermal sublimation printer further utilizes an adjusting member, such as an adjusting screw, corresponding to each spring to compress the corresponding spring, so as to adjust the pressure provided by the corresponding spring. When a ribbon on the aforesaid thermal print head is heated, dyes on the ribbon can be transferred onto a print medium. Practically, there are tolerances of rigidities existing among the springs, resulting in defects of printed images, such as poor uniformity, wrinkles, drag lines and so on due to unbalance pressures applied by the springs when the thermal print head is in thermal printing. As a result, it reduces quality of printed images and advantages of products in the market.

SUMMARY OF THE INVENTION

The present invention provides a pressure adjusting mechanism for adjusting pressure of a thermal print head and a thermal sublimation printer therewith for solving above drawbacks.

According to the claimed invention, a pressure adjusting mechanism for adjusting pressure applied on a thermal print head includes a pressing plate, a plurality of resilient members and a pressure adjusting member. The pressing plate is disposed above the thermal print head, and the pressing plate includes a first pressed section and a second pressed section connected to the first pressed section. The plurality of resilient members is connected to the first pressed section of the pressing plate and the thermal print head and to the second pressed section of the pressing plate and the thermal print head, respectively. The pressure adjusting member is pivoted to the pressing plate. The pressure adjusting member is for driving the pressing plate to move relative to the thermal print head, so as to press the plurality of resilient members for providing the thermal print head with pressure, such that the plurality of resilient members drives the pressing plate to pivot relative to the pressure adjusting member for equilibrating the pressing plate.

According to the claimed invention, the pressing plate further includes a pivoting structure connected to the first pressed section and the second pressed section, and the pressure adjusting member includes a pivoting end portion and an adjusting portion. The pivoting end portion is pivoted to the pivoting structure. The adjusting portion is connected to the pivoting end portion for driving the pressing plate to move relative to the thermal print head.

According to the claimed invention, the plurality of resilient members includes an even number of resilient members respectively disposed on two sides of the pressing plate symmetrically to the pressure adjusting member and abutting against the first pressed section and the second pressed section.

According to the claimed invention, the pivoting structure is a semi-spherical recess, the pivoting end portion is a semi-spherical structure, and the adjusting portion is a thread structure.

According to the claimed invention, a length of the first pressed section is substantially identical to a length of the second pressed section.

According to the claimed invention, a sum of moments applied on the first pressed section relative to the pressure adjusting member is substantially identical to a sum of moments applied on the second pressed section relative to the pressure adjusting member.

According to the claimed invention, each of the resilient members is a spring.

According to the claimed invention, a thermal sublimation printer includes a holding roller, a thermal print head and a pressure adjusting mechanism. The holding roller is for holding a print medium. The thermal print head is for transferring a dye on a ribbon onto the print medium. The pressure adjusting mechanism for adjusting pressure applied on the thermal print head includes a pressing plate, a plurality of resilient members and a pressure adjusting member. The pressing plate is disposed above the thermal print head, and the pressing plate includes a first pressed section and a second pressed section connected to the first pressed section. The plurality of resilient members is connected to the first pressed section of the pressing plate and the thermal print head and to the second pressed section of the pressing plate and the thermal print head, respectively. The pressure adjusting member is pivoted to the pressing plate. The pressure adjusting member is for driving the pressing plate to move relative to the thermal print head, so as to press the plurality of resilient members for providing the thermal print head with pressure, such that the plurality of resilient members drives the pressing plate to pivot relative to the pressure adjusting member for equilibrating the pressing plate.

In summary, the present invention utilizes the pressing plate as a pressure adjustment mechanism. When the pressure adjusting member pivoted to the pressing plate drives the pressing plate to move relative to the thermal print head, the pressing plate deforms the plurality of resilient members disposed on the first pressed section of the pressing plate and the second pressed section of the pressing plate relative to the thermal print head, such that the resilient members are compressed to provide the thermal print head with the pressures. In addition, there might be tolerances of rigidities among the resilient members. When the pressing plate presses the plurality of resilient members by the same distance, the resilient members generate different resilient forces accordingly. As a result, the sum of moments applied on the first pressed section relative to the pressure adjusting member is different from the sum of moments applied on the second pressed section relative to the pressure adjusting member, such that the pressing plate rotates relative to the pressure adjusting member until the sum of moments applied on the first pressed section relative to the pressure adjusting member is substantially identical to the sum of moments applied on the second pressed section relative to the pressure adjusting member. In the meanwhile, it can equilibrate the pressing plate. In other words, the pressing plate can utilize the pressure adjusting member as a pivot, so as to rotate relative to the pressure adjusting member for equilibrating the pressures on the thermal print head applied by the resilient members. In such a manner, the present invention can eliminate defects of printed images, such as poor uniformity, wrinkles, drag lines and so on when the thermal print head is in thermal printing. As a result, it enhances quality of printed images and advantages of products in the market.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
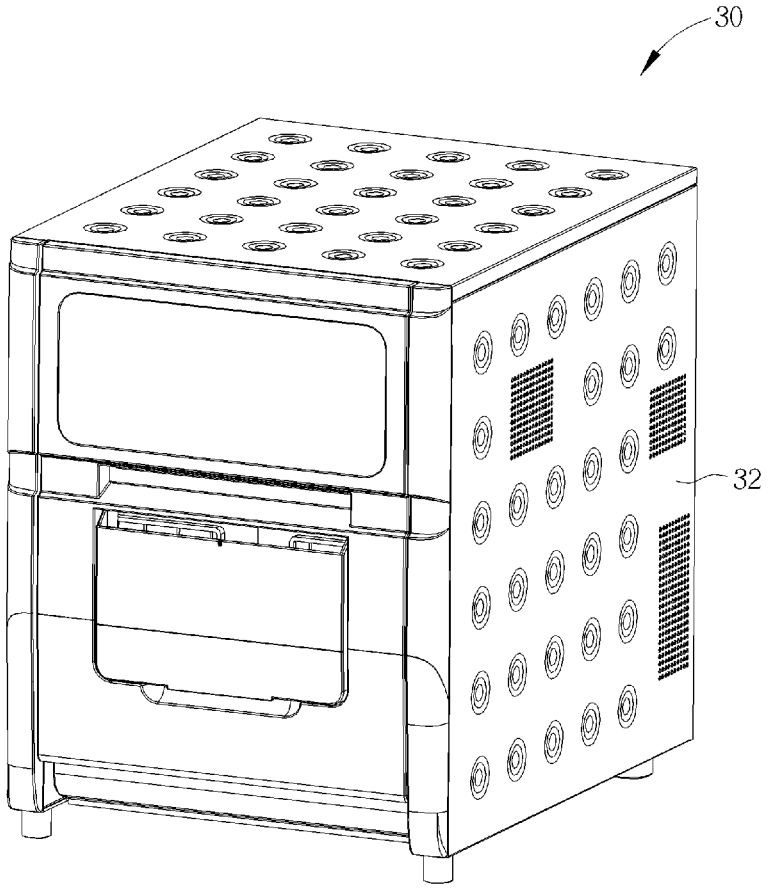
FIG. 1 is a schematic diagram of a thermal sublimation printer according to a preferred embodiment of the present invention.
Figure 2:
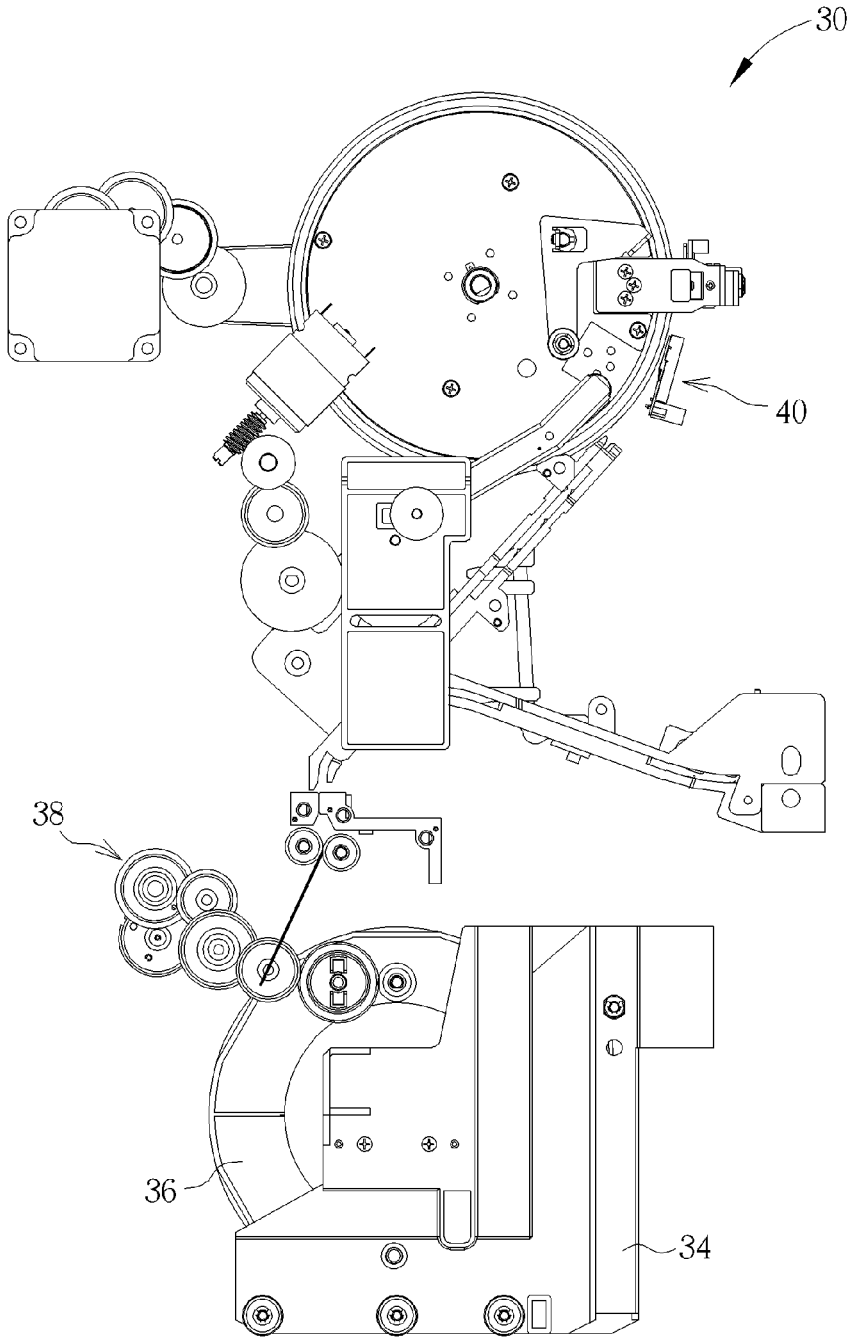
FIG. 2 is an internal diagram of the thermal sublimation printer according to the preferred embodiment of the present invention.

Please refer to FIG. 1 and FIG. 2. FIG. 1 is a schematic diagram of a thermal sublimation printer 30 according to a preferred embodiment of the present invention. FIG. 2 is an internal diagram of the thermal sublimation printer 30 according to the preferred embodiment of the present invention. As shown in FIG. 1 and FIG. 2, the thermal sublimation printer 30 includes a casing 32 and a holding member 34. The holding member 34 is disposed on a bottom of the casing 32 for holding a print medium 36, such as a paper roll. Furthermore, the thermal sublimation printer 30 further includes a conveying mechanism 38 and a thermal print head module 40. The conveying mechanism 38 is used for conveying the print medium 36 to the thermal print head module 40. Accordingly, the thermal print head module 40 can perform following thermal printing process, so as to transfer an image onto the print medium 36.

Figure 3:
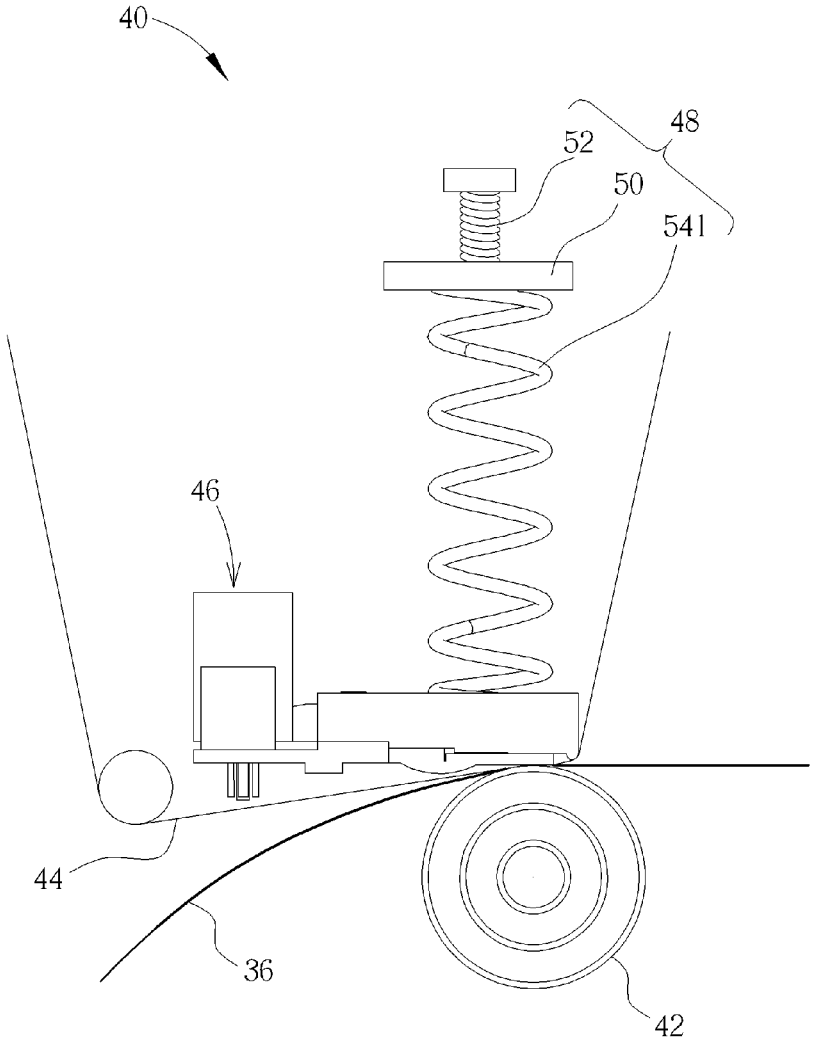
FIG. 3 is a diagram of a thermal print head module according to the preferred embodiment of the present invention.
Figure 4:
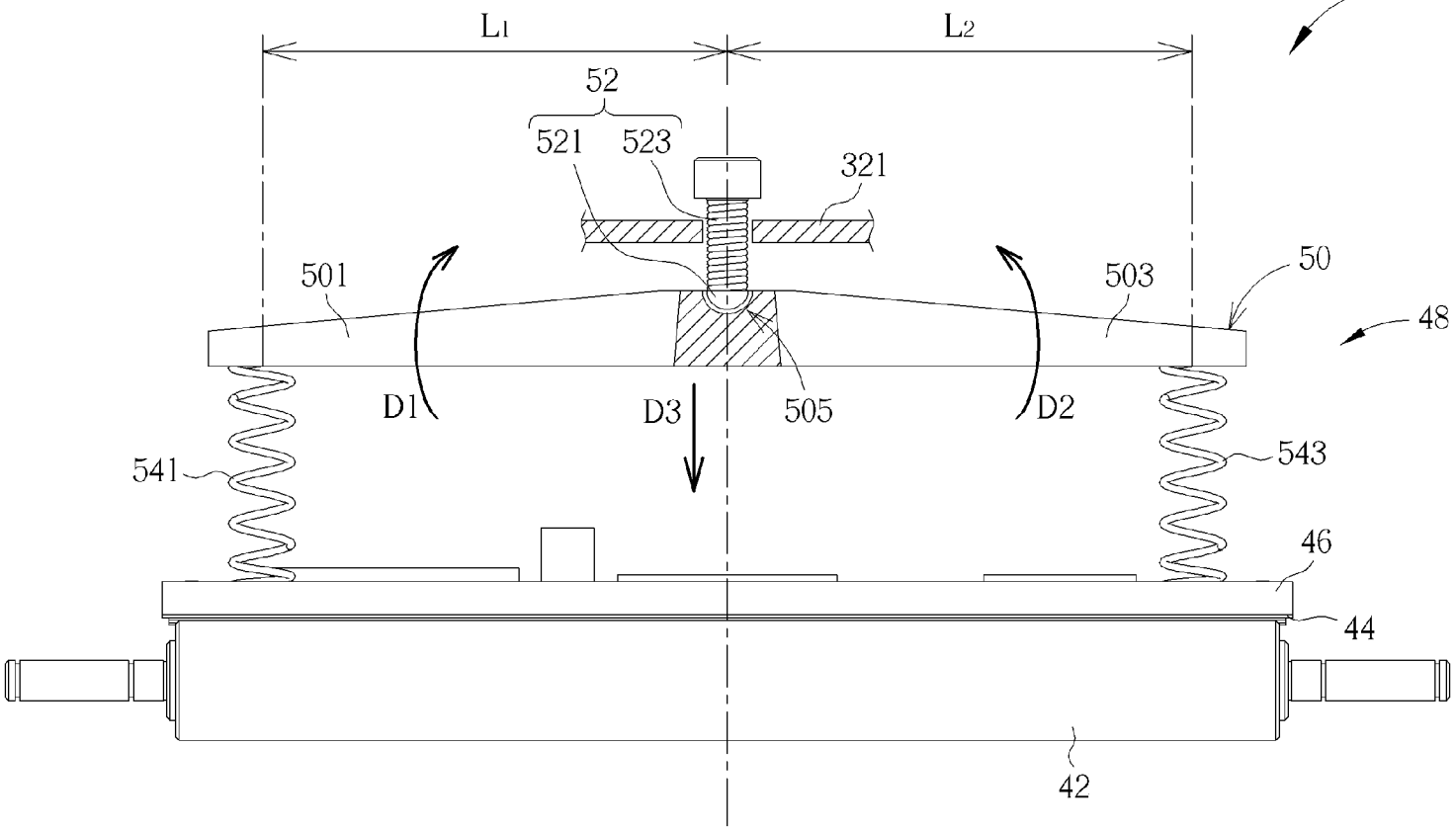
FIG. 4 is a diagram of the thermal print head module in another view according to the preferred embodiment of the present invention.

Please refer to FIG. 2 to FIG. 4. FIG. 3 is a diagram of the thermal print head module 40 according to the preferred embodiment of the present invention. FIG. 4 is a diagram of the thermal print head module 40 in another view according to the preferred embodiment of the present invention. As shown in FIG. 2 to FIG. 4, the thermal print head module 40 includes a holding roller 42, a ribbon 44 and a thermal print head 46. When the print medium 36 is conveyed by the conveying mechanism 38 to the thermal print head module 40, the holding roller 42 of the thermal print head module 40 is used for holding the print medium 36, such that the thermal print head 46 of the thermal print head module 40 transfers dye on the ribbon 44 onto the print medium 36 by thermal printing technology. In addition, the thermal print head module 40 further includes a pressure adjusting mechanism 48. The pressure adjusting mechanism 48 is used for applying pressure on the thermal print head 46 during the thermal printing process, such that the dye on the ribbon 44 is transferred onto the print medium 36 stably.

Furthermore, the pressure adjusting mechanism 48 includes a pressing plate 50 disposed above the thermal print head 46. The pressing plate 50 includes a first pressed section 501, a second pressed section 503 and a pivoting structure 505. The second pressed section 503 is connected to the first pressed section 501, and the pivoting structure 505 is connected to the first pressed section 501 and the second pressed section 503. In other words, the pivoting structure 505 is disposed at a joint of the first pressed section 501 and the second pressed section 503. In this embodiment, the first pressed section 501 has a first length L1, the second pressed section 503 has a second length L2, and the first length L1 can be substantially identical to the second length L2. In summary, the pressing plate 50 can be a symmetric structure, and the pivoting structure 505 is located in a symmetric center of the pressing plate 50. In other words, the first pressed section 501 and the second pressed section 503 are symmetric to each other relative to the pivoting structure 505.

In addition, the pressure adjusting mechanism 48 further includes a pressure adjusting member 52 pivoted to the pressing plate 50. Furthermore, the pressure adjusting member 52 includes a pivoting end portion 521 pivoted to the pivoting structure 505 of the pressing plate 50, such that the pressing plate 50 is capable of rotating relative to the pressure adjusting member 52 in a first direction D1 or in a second direction D2 opposite to the first direction D1, as shown in FIG. 4. Furthermore, the pressure adjusting member 52 further includes an adjusting portion 523 connected to the pivoting end portion 521. The adjusting portion 523 is capable of moving relative to a fixing structure 321 on the casing 32 of the thermal sublimation printer 30, so as to drive the pressing plate 50 to move upwards and downwards relative to the thermal print head 46.

In this embodiment, the pressure adjusting member 52 can be an adjusting screw, and the adjusting portion 523 of the pressure adjusting member 52 can be a thread structure. Furthermore, the pivoting end portion 521 of the pressure adjusting member 52 can be a semi-spherical structure of an end of the adjusting screw, and the pivoting structure 505 of the pressing plate 50 can be a semi-spherical recess corresponding to the aforesaid semi-spherical structure. By cooperation of the structures mentioned above, the pivoting end portion 521 of the pressure adjusting member 52 can be pivoted to the pivoting structure 505 of the pressing plate 50. It should be noticed that structures of the pivoting end portion 521 of the pressure adjusting member 52 and the pivoting structure 505 of the pressing plate 50 are not limited to those mentioned above. For example, the pivoting end portion 521 and the pivoting structure 505 can respectively be a pivoting pin and a pivoting hole as well. In other words, structures capable of pivoting the pivoting end portion 521 of the pressure adjusting member 52 and the pivoting structure 505 of the pressing plate 50 are within the scope of the present invention.

In addition, the pressure adjusting mechanism 48 further includes a first resilient member 541 and a second resilient member 543. The first resilient member 541 is connected to an end of the first pressed section 501 of the pressing plate 50 and the thermal print head 46, and the second resilient member 543 is connected to an end of the second pressed section 503 of the pressing plate 50 and the thermal print head 46. In other words, the first resilient member 541 and the second resilient member 543 are away from the pressure adjusting member 52 by the first length L1 and by the second length L2, respectively. In this embodiment, each of the first resilient member 541 and the second resilient member 543 can be a spring. Furthermore, when the pressure adjusting member 52 is rotated to move the adjusting portion 523 relative to the fixing structure 321 in a third direction D3 shown in FIG. 4, the pivoting end portion 521 of the pressure adjusting member 52 drives the pressing plate 50 to move relative to the thermal print head 46 in the third direction D3, so as to compress the first resilient member 541 and the second resilient member 543. Accordingly, the first resilient member 541 and the second resilient member 543 are compressed to provide the thermal print head 46 with the pressure, such that the dye on the ribbon 44 of the thermal print head module 40 is transferred onto the print medium 36 stably during the thermal printing process.

More detailed description for principle of the pressure adjusting mechanism 48 is provided as follows. Practically, there might be a certain tolerance of rigidity between the first resilient member 541 and the second resilient member 543. When the aforesaid first resilient member 541 and the second resilient member 543 are compressed, pressure on the first pressed section 501 applied by the first resilient member 541 needs to be substantially identical to pressure on the second pressed section 503 applied by the second resilient member 543 for equilibrating the pressing plate 50. First of all, a resilient force generated by the first resilient member 541 can be defined as the product of the rigidity of the first resilient member 541 and the deformation of the first resilient member 541, and a resilient force generated by the second resilient member 543 can be defined as the product of the rigidity of the second resilient member 543 and the deformation of the second resilient member 543. When the pivoting end portion 521 of the pressure adjusting member 52 drives the pressing plate 50 to move relative to the thermal print head 46 in the third direction D3 by the same distance, that is, when first resilient member 541 deforms identically to the second resilient member 543, the resilient forces respectively generated by the first resilient member 541 and the second resilient member 543 might be different from each other due to the different rigidities thereof. In the meanwhile, the pressing plate 50 can not be equilibrated.

For example, if the pressure on the first pressed section 501 applied by the first resilient member 541 is greater than the pressure on the second pressed section 503 applied by the second resilient member 543, a moment of the pressure on the first pressed section 501 applied by the first resilient member 541 relative to the pressure adjusting member 52 is greater than a moment of the pressure on the second pressed section 503 applied by the second resilient member 543 relative to the pressure adjusting member 52. Accordingly, the first resilient member 541 drives the pressing plate 50 to rotate relative to the pressure adjusting member 52 in the first direction D1, until the moment of the pressure on the first pressed section 501 applied by the first resilient member 541 relative to the pressure adjusting member 52 is substantially identical to the moment of the pressure on the second pressed section 503 applied by the second resilient member 543 relative to the pressure adjusting member 52. In the meanwhile, although the deformations of the first resilient member 541 and the second resilient member 543 are different from each other, the resilient force provided by the first resilient member 541 is identical to the resilient force provided by the second resilient member 543. Furthermore, since the first length L1 of the first pressed section 501 is identical to the second length L2 of the second pressed section 503, the moment of the first resilient member 541 relative to the pressure adjusting member 52 and the moment of the second resilient member 543 relative to the pressure adjusting member 52 are identical and acted in directions opposite to each other, so as to equilibrate the pressing plate 50. In such a manner, the pressure adjusting mechanism 48 can be utilized for adjusting the pressure applied on the thermal print head 46, so as to equilibrate the pressing plate 50 stably. Accordingly, the quality of printed images can be improved.

On the other hand, if the pressure on the second pressed section 503 applied by the second resilient member 543 is greater than the pressure on the first pressed section 501 applied by the first resilient member 541, the moment of the pressure on the second pressed section 503 applied by the second resilient member 543 relative to the pressure adjusting member 52 is greater than the moment of the pressure on the first pressed section 501 applied by the first resilient member 541 relative to the pressure adjusting member 52. Accordingly, the second resilient member 543 drives the pressing plate 50 to rotate relative to the pressure adjusting member 52 in the second direction D2, until the moment of the pressure on the first pressed section 501 applied by the first resilient member 541 relative to the pressure adjusting member 52 is substantially identical to the moment of the pressure on the second pressed section 503 applied by the second resilient member 543 relative to the pressure adjusting member 52. In the meanwhile, although the deformations of the first resilient member 541 and the second resilient member 543 are different from each other, the resilient force provided by the first resilient member 541 is identical to the resilient force provided by the second resilient member 543. Furthermore, since the first length L1 of the first pressed section 501 is identical to the second length L2 of the second pressed section 503, the moment of the first resilient member 541 relative to the pressure adjusting member 52 and the moment of the second resilient member 543 relative to the pressure adjusting member 52 are identical and acted in directions opposite to each other, so as to equilibrate the pressing plate 50 stably. In such a manner, the pressure adjusting mechanism 48 can be utilized for adjusting the pressure applied on the thermal print head 46, so as to equilibrate the pressing plate 50. Accordingly, the quality of printed images can be improved.

Figure 5:
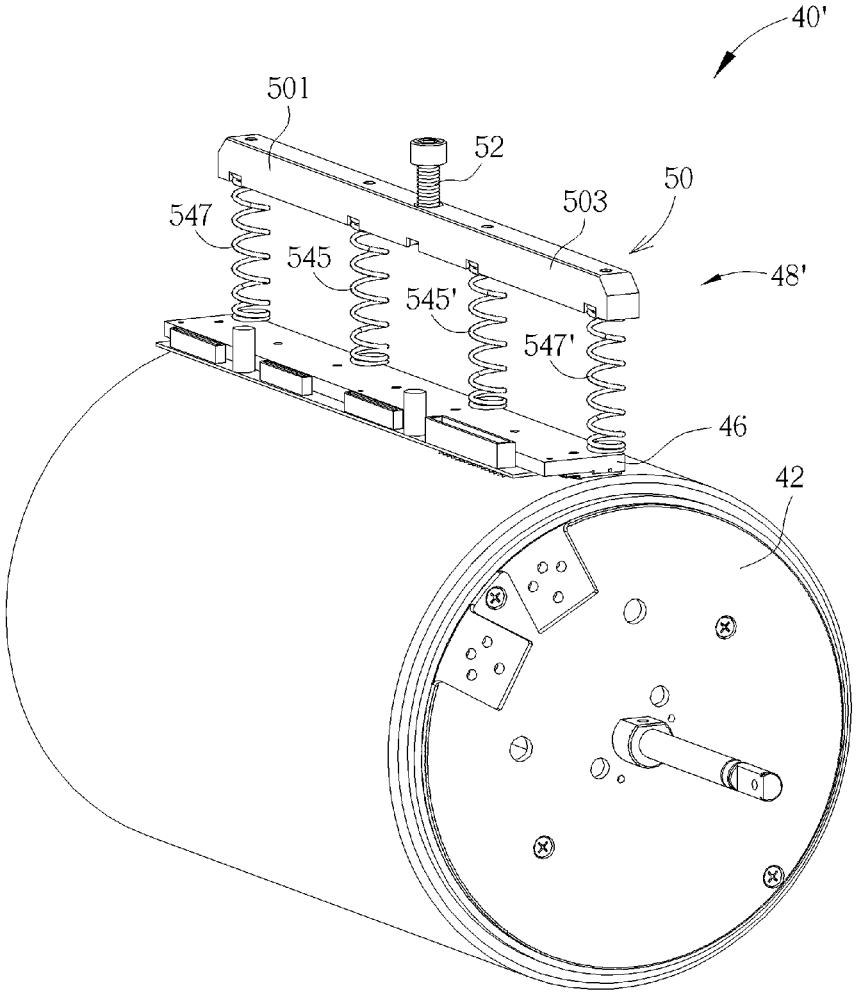
FIG. 5 is a diagram of a thermal print head module according to another embodiment of the present invention.

Please refer to FIG. 5. FIG. 5 is a diagram of a thermal print head module 40' according to another embodiment of the present invention. As shown in FIG. 5 and FIG. 4, a main difference between the thermal print head module 40' and the aforesaid thermal print head module 40 is that a pressure adjusting mechanism 48' of the thermal print head module 40' includes four resilient members 545, 545', 547, 547'. Furthermore, the resilient members 545, 547 abut against the first pressed section 501 of the pressing plate 50 and the thermal print head 46, and the resilient members 545', 547' abut against the second pressed section 503 of the pressing plate 50 and the thermal print head 46. In addition, the resilient members 545, 545' are disposed on two sides of the pressing plate 50 symmetrically to the pressure adjusting member 52, and the resilient members, 547, 547' are disposed on the two sides of the pressing plate 50 symmetrically to the pressure adjusting member 52 as well. The principle of the pressure adjusting mechanism 48' is similar to the principle of the pressure adjusting mechanism 48, and further description is omitted herein for simplicity. It should be noticed that amount and disposal of the resilient members of the pressure adjusting mechanism of the present invention are not limited to that mentioned above. For example, the pressure adjusting mechanism can include six or eight resilient members as well. In other words, mechanism with an even number of the resilient members and each of the resilient members abutting against on the two sides of the pressing plate symmetrically to the pressure adjusting member is within the scope of the present invention.

Compared to the prior art, the present invention utilizes the pressing plate as a pressure adjustment mechanism. When the pressure adjusting member pivoted to the pressing plate drives the pressing plate to move relative to the thermal print head, the pressing plate deforms the plurality of resilient members disposed on the first pressed section of the pressing plate and the second pressed section of the pressing plate relative to the thermal print head, such that the resilient members are compressed to provide the thermal print head with the pressures. In addition, there might be tolerances of rigidities among the resilient members. When the pressing plate presses the plurality of resilient members by the same distance, the resilient members generate different resilient forces accordingly. As a result, the sum of moments applied on the first pressed section relative to the pressure adjusting member is different from the sum of moments applied on the second pressed section relative to the pressure adjusting member, such that the pressing plate rotates relative to the pressure adjusting member until the sum of moments applied on the first pressed section relative to the pressure adjusting member is substantially identical to the sum of moments applied on the second pressed section relative to the pressure adjusting member. In the meanwhile, it can equilibrate the pressing plate. In other words, the pressing plate can utilize the pressure adjusting member as a pivot, so as to rotate relative to the pressure adjusting member for equilibrating the pressures on the thermal print head applied by the resilient members. In such a manner, the present invention can eliminate defects of printed images, such as poor uniformity, wrinkles, drag lines and so on when the thermal print head is in thermal printing. As a result, it enhances quality of printed images and advantages of products in the market.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A pressure adjusting mechanism for adjusting pressure applied on a thermal print head, the pressure adjusting mechanism comprising:

a pressing plate disposed above the thermal print head, the pressing plate comprising a first pressed section and a second pressed section connected to the first pressed section;

a plurality of resilient members connected to the first pressed section of the pressing plate and the thermal print head and to the second pressed section of the pressing plate and the thermal print head, respectively; and a pressure adjusting member pivoted to the pressing plate, the pressure adjusting member being for driving the pressing plate to move relative to the thermal print head, so as to press the plurality of resilient members for providing the thermal print head with pressure, such that the plurality of resilient members drives the pressing plate to pivot relative to the pressure adjusting member for equilibrating the pressing plate.

2. The pressure adjusting mechanism of claim 1, wherein the pressing plate further comprises a pivoting structure connected to the first pressed section and the second pressed section, and the pressure adjusting member comprises:

a pivoting end portion pivoted to the pivoting structure; and an adjusting portion connected to the pivoting end portion for driving the pressing plate to move relative to the thermal print head.

3. The pressure adjusting mechanism of claim 2, wherein the plurality of resilient members comprises an even number of resilient members respectively disposed on two sides of the pressing plate symmetrically to the pressure adjusting member and abutting against the first pressed section and the second pressed section.

4. The pressure adjusting mechanism of claim 2, wherein the pivoting structure is a semi-spherical recess, the pivoting end portion is a semi-spherical structure, and the adjusting portion is a thread structure.

5. The pressure adjusting mechanism of claim 1, wherein a length of the first pressed section is substantially identical to a length of the second pressed section.

6. The pressure adjusting mechanism of claim 1, wherein a sum of moments applied on the first pressed section relative to the pressure adjusting member is substantially identical to a sum of moments applied on the second pressed section relative to the pressure adjusting member.

7. The pressure adjusting mechanism of claim 1, wherein each of the resilient members is a spring.

8. A thermal sublimation printer, comprising:

a holding roller for holding a print medium;

a thermal print head for transferring a dye on a ribbon onto the print medium; and a pressure adjusting mechanism for adjusting pressure applied on the thermal print head, the pressure adjusting mechanism comprising:

a pressing plate disposed above the thermal print head, the pressing plate comprising a first pressed section and a second pressed section connected to the first pressed section;

a plurality of resilient members connected to the first pressed section of the pressing plate and the thermal print head and to the second pressed section of the pressing plate and the thermal print head, respectively; and a pressure adjusting member pivoted to the pressing plate, the pressure adjusting member being for driving the pressing plate to move relative to the thermal print head, so as to press the plurality of resilient members for providing the thermal print head with pressure, such that the plurality of resilient members drives the pressing plate to pivot relative to the pressure adjusting member for equilibrating the pressing plate.

9. The thermal sublimation printer of claim 8, wherein the pressing plate further comprises a pivoting structure connected to the first pressed section and the second pressed section, and the pressure adjusting member comprises:

a pivoting end portion pivoted to the pivoting structure; and an adjusting portion connected to the pivoting end portion for driving the pressing plate to move relative to the thermal print head.

10. The thermal sublimation printer of claim 9, wherein the plurality of resilient members comprises an even number of resilient members respectively disposed on two sides of the pressing plate symmetrically to the pressure adjusting member and abutting against the first pressed section and the second pressed section.

11. The thermal sublimation printer of claim 9, wherein the pivoting structure is a semi-spherical recess, the pivoting end portion is a semi-spherical structure, and the adjusting portion is a thread structure.

12. The thermal sublimation printer of claim 8, wherein a length of the first pressed section is substantially identical to a length of the second pressed section.

13. The thermal sublimation printer of claim 8, wherein a sum of moments applied on the first pressed section relative to the pressure adjusting member is substantially identical to a sum of moments applied on the second pressed section relative to the pressure adjusting member.

14. The thermal sublimation printer of claim 8, wherein each of the resilient members is a spring.

* * * * *